US005940902A

United States Patent [19]

Onge et al.

[11] Patent Number: 5,940,902

[45] Date of Patent: Aug. 24, 1999

[54] TELESCOPING BATHTUB ASSEMBLY

[76] Inventors: Page B. Onge; Jeannine M. Onge, both of P.O. Box 50856, Nashville, Tenn. 37205

[21] Appl. No.: 08/957,989

[22] Filed: Oct. 7, 1997

Related U.S. Application Data

[63] Continuation of application No. 08/548,193, Oct. 25, 1995, abandoned.

[51] Int. Cl.[6] ..... A47R 3/02

[52] U.S. Cl. ..... 4/555; 4/560.1; 4/573.1; 4/584

[58] Field of Search ..... 4/539, 540, 547, 4/548, 549, 555, 556, 560.1, 566.1, 571.3, 573.1, 584, 592, 593, 594

[56] References Cited

U.S. PATENT DOCUMENTS

| | | | |
|---|---|---|---|
| 2,798,229 | 7/1957 | McQuown | 4/564.1 |
| 3,842,449 | 10/1974 | Geurtsen et al. | 4/555 X |
| 3,994,030 | 11/1976 | Cassell et al. | 4/563.1 |
| 4,221,009 | 9/1980 | Wright | 4/566.1 |
| 4,432,104 | 2/1984 | Sasaki | 4/555 |
| 4,583,251 | 4/1986 | Kavi et al. | 4/555 |
| 4,890,341 | 1/1990 | Forbes | 4/555 |
| 4,928,329 | 5/1990 | Palmeri | 4/552 |
| 4,993,087 | 2/1991 | Roquebrune | 4/555 |
| 4,996,729 | 3/1991 | Zellner | 4/547 X |
| 5,184,358 | 2/1993 | Gruidel et al. | 4/555 |
| 5,351,345 | 10/1994 | Sills et al. | 4/555 |

FOREIGN PATENT DOCUMENTS

| | | | |
|---|---|---|---|
| 648741 | 4/1994 | Australia | 4/573.1 |
| 1478182 | 4/1967 | France | 4/564.1 |
| 2515500 | 5/1983 | France | 4/555 |
| 0225613 | 8/1985 | Germany | 4/560.1 |
| 2227934 | 8/1990 | United Kingdom | 4/560.1 |

OTHER PUBLICATIONS

"Roll Tub", Tilt Tub, Inc., 5210 Kentucky Dam Road, Paducah, KY 42003, 2 pgs., May 1995.

Health Care Equipment, David B. Storm & Associates, 12 pgs., no date.

"Arjo–Century's Whirlpool Bathing Systems", Arjo–Century, 6380 Oakton Street, Morton Grove, ILL 60053, 2 pgs., no date.

"Arjo–Century Sonata Bathing System", Arjo–Century, Inc., 8130 Lehigh Avenue, Morton Grove, ILL 60053, 15 pgs., no date.

*Primary Examiner*—Robert M. Fetsuga

*Attorney, Agent, or Firm*—Waddey & Patterson; I. C. Waddey, Jr.

[57] ABSTRACT

A bathing tub including a bathing basket with an open front with a seating area, a back and opposing ends. The seating area can be adjusted in height and then fixed at a level approximately buttock high above a support surface so that a bather can easily slide into the seating area of the basket from a standing position through the open front. Once the bather is in the basket, a front rail is moved into a closing position to provide the bather with some support across the front of the basket and to prevent the bather from falling out of the basket. Next, a remote reservoir which has been pre-filled with a bathing liquid, usually body temperature bathing water, is raised and surrounds the bathing basket or the bathing basket is lowered into the remote reservoir to accomplish the same effect. The water will flow at a rapid pace into the bathing basket and the bather will thus be quickly immersed in water that has been pretempered to the desired temperature to any level of immersion desired. At any time during the bathing process, the side access bathing basket may be adjusted to a perfect height for a bathing assistant to attend to the bather without having to bend over and place strain on the assistant's back.

7 Claims, 8 Drawing Sheets

TELESCOPING BATHTUB ASSEMBLY

This is a continuation of co-pending U.S. patent application Ser. No. 08/548,193 filed on Oct. 25, 1995 for "Telescoping Bathtub Assembly", now abandoned.

BACKGROUND OF THE INVENTION

The present invention relates generally to bath tubs and more particularly to a bathing tub for persons with some physical or mental impairment which generally results in the need for a bathing assistant. My invention is particularly useful for persons with impaired ambulatory ability, obesity, inadequate or unreliable judgment, persons who are susceptible to a loss of consciousness during the bathing process, and for those who have the desire for a safer, easier, more convenient method of bathing.

It will be appreciated by those skilled in the art that conventional bathtubs have a number of deficiencies in terms of their ability to serve the needs for physically or mentally impaired persons. First, it can be difficult for the physically or mentally impaired to get in or out of a conventional bathtub. Conventional bathtubs require a person to step over the side wall of the tub, an obstacle that may cause the physically impaired to trip and injure themselves in or about the tub. Also, the bathtub itself may have a slippery surface which is more difficult to navigate for the physically impaired, and non-slip surfaces and grab bars are often an inadequate solution for those who have minimal strength.

Showers do not necessarily solve the problem because of the danger of slip and fall accidents and the inability of sick and infirm persons to stand for an extended period of time during showers. Also, showers do not lend themselves to assisted bathing since the assistant would get sprayed during the showering process.

There have been several attempts to address the problems associated with assisted bathing. One of the primary efforts has been the hoist-type systems which involves placing the person in a hammock-like structure, hoisting him over a tub of water and lowering him into the tub for the bathing process. The primary problems with the hoist-type systems are the fact that such devices are awkward and dangerous to manipulate, as well as being dehumanizing and humiliating to the patient.

In addition to the hoist-type systems, there have been developed a number of side access bathing tubs in which the patient lowers or moves the side of the tub out of the way, sits into the tub, raises or moves the side of the tub back in place, has the tub filled with water and then engages in the bathing process. Problems with devices of this nature involve side door maintenance, and sealing to avoid leaks in the tub, delays in the tub filing process, having to empty the tub if the person has to get out of the tub before the bath is completed, etc.

Another approach has been to provide side access with a tub chamber that tilts for access. However, these devices as well as all other prior art side access bathing tubs cannot be pre-filled and the bather must suffer the discomfort while the tub is filling of sitting in a potentially cold tub during the extended time that it takes to fill the tub. Further, the tub surfaces cannot be pre-warmed by having the water in the tub immediately prior to the bather entering the tub and the bather can be scalded or chilled by the water as it is filling the tub or irritated or injured by undiluted additives added to the bath water while the bather is in the tub.

Practically all of these prior art efforts at solving problems associated with assisted bathing for the mentally or physically impaired involve structures that cannot be quickly drained and re-filled with the same bathing liquid resulting in a waste of water when the bather has to get out of the tub in the middle of the bathing process, for example to go to the toilet, involve dangers in egress and ingress in the tub, or are inconvenient to use. Further, these prior art devices do not deal with the problems associated with unattended immobility of the bather, loss of consciousness and the like that may result in drowning.

SUMMARY OF THE INVENTION

The assisted bathing device of the present invention overcomes the problems of the prior art by providing an adjustable height, side access bathing basket, and a remote reservoir that is moveable to fit about the basket after the bather is in the basket. In Applicant's invention, the bathing basket has an open front with a seating area, a back and opposing ends. The seating area can be adjusted in height and then fixed at a level approximately buttock high above a support surface so that a bather can easily slide into the seating area of the basket through the open front. Once the bather is in the basket, a front rail is moved into a closing position to provide the bather with some support across the front of the basket and to prevent the bather from falling out of the basket. Next, a remote reservoir which has been pre-filled with a bathing liquid, usually body temperature bathing water, is raised and surrounds the bathing basket or the bathing basket is lowered into the remote reservoir to accomplish the same effect. The water will flow at a rapid pace into the bathing basket and the bather will thus be quickly immersed to any level of immersion desired in water that has been pretempered to the desired temperature. At any time during the bathing process, the side access bathing basket may be adjusted to a perfect height for a bathing assistant to attend to the bather without having to bend over and place strain on the assistant's back.

If the bather has to go to the toilet during the course of the bathing process or even worse, if the bather becomes unconscious during the bathing process, the water can be drained quickly from the bathing basket by simply lowering the remote reservoir or raising the bathing basket out of the remote reservoir. The drain of the water from the basket is not limited by the plumbing structure associated with the system but rather the water simply drops as the remote reservoir drops. Also, the water can be retained in the remote reservoir if the patient has to leave the basket before the bath is completed; thereafter, he can return to the basket, and the same water can be used to complete the bathing process by simply raising the remote reservoir.

DESCRIPTION OF THE PREFERRED EMBODIMENT

The present invention will be best understood when considered in light of the following description of the preferred embodiment of the invention as is illustrated in FIGS. 1–9 of the accompanying drawings.

Figure 1:
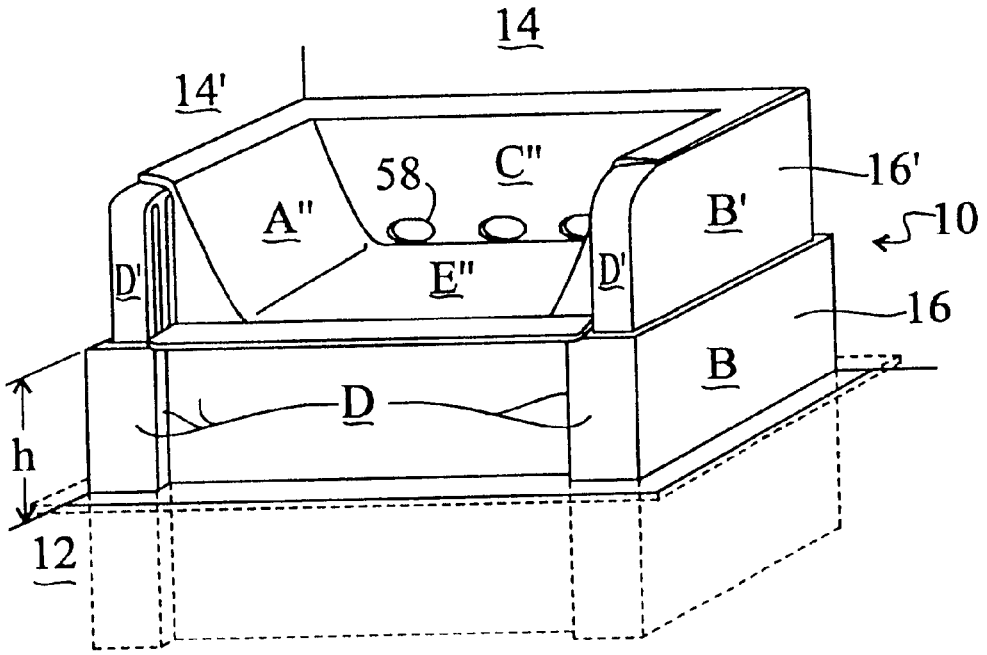
FIG. 1 is a schematic, perspective view of the remote reservoir tub of the present invention.

FIG. 1 illustrates schematically and in perspective, the tub 10 in its fully assembled configuration with the door to the tub opened. The tub 10 will generally be mounted on a floor-type surface 12 and may be positioned against a wall 14 or against two walls 14, 14' forming a comer location for the tub.

Figure 1A:
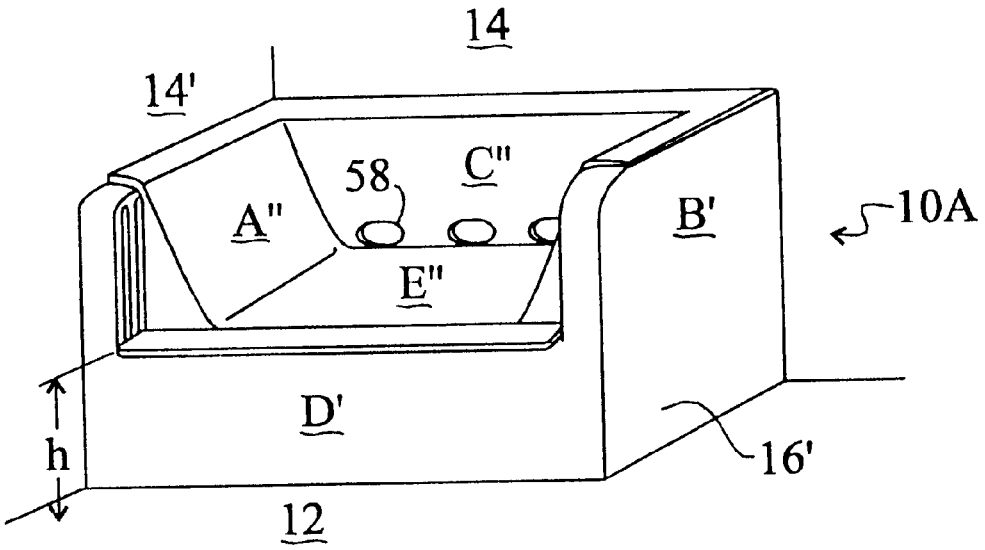
FIG. 1*a* is a schematic, perspective view of an alternative structure of the remote reservoir tub of the present invention.
Figure 2:
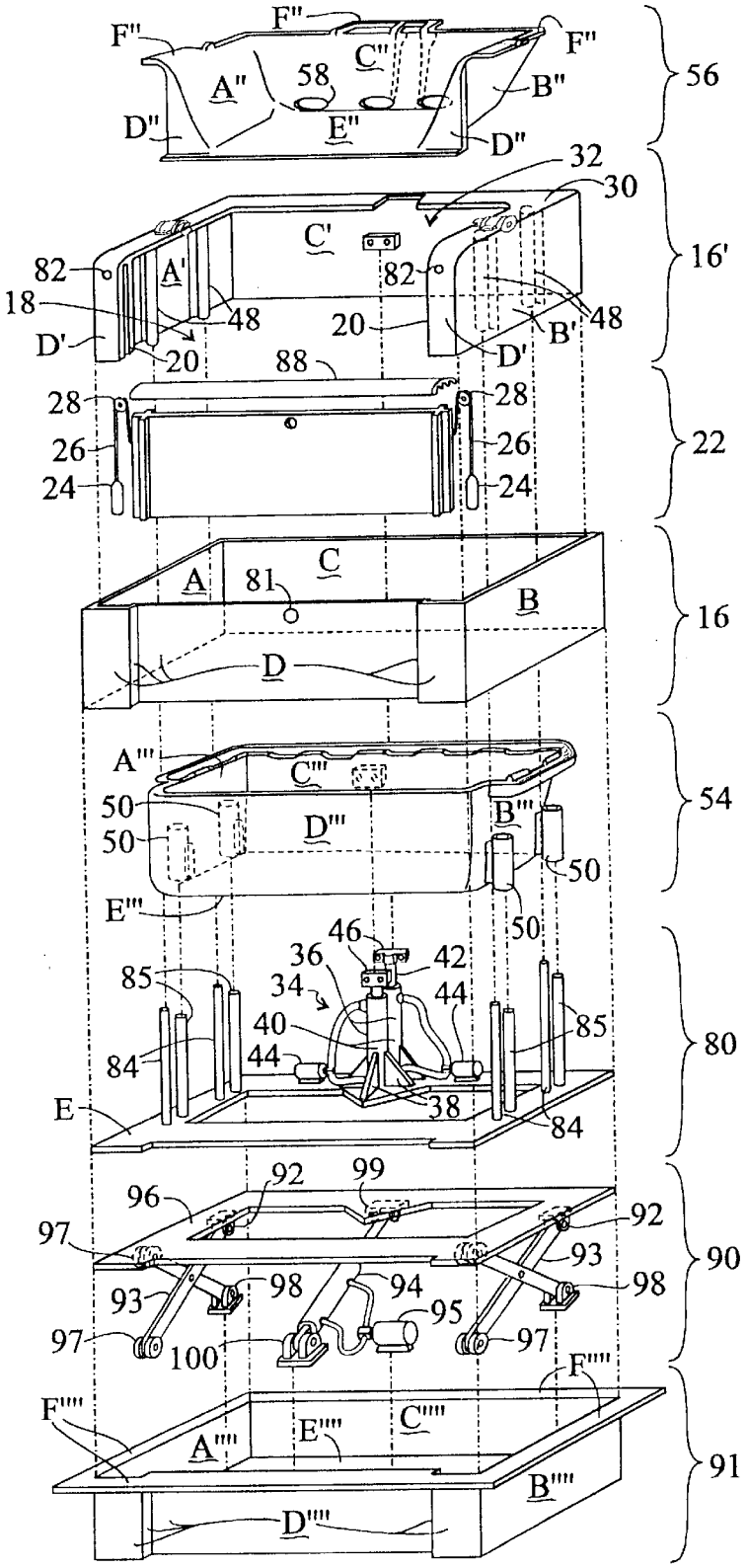
FIG. 2 is an exploded view in perspective of the tub of the present invention.
Figure 3:
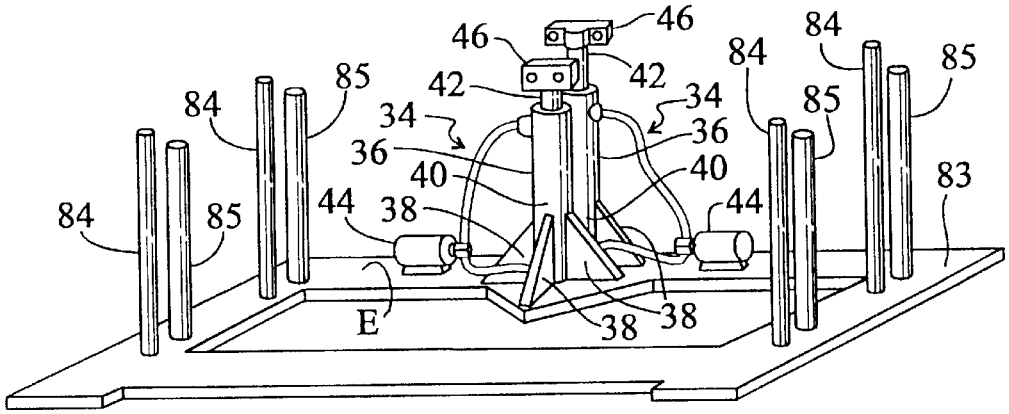
FIG. 3 is a view in perspective of the lifting mechanism of the present invention.

The tub 10 is fitted within a lower housing 16 and an upper housing 16' which would generally be molded or formed by the assembly of a number of panels. FIG. 1*a* shows tub 10A, a variation on the present invention where only the remote reservoir and the side door can be raised and lowered and only one housing is required. Both FIGS. 1 and 2 show both housings, but referring to FIG. 2, the panels that form the lower housing 16 have been identified by letters A, B, C, and D designating opposing ends A and B, a back C, and a front D, and the panels that form the upper housing 16' have been identified by letters A', B', C', D', and F' designating opposing ends A' and B', a back C', a front D', and a top F'. The front panel D' has a gap 18 which is generally open, having opposing parallel sides. Slots 20 are formed in the face of the opposing parallel sides of the gap 18 in panel D' of the upper housing 16'. Door 22 fits within the slots 20 and is movable between an open position with the door dropped into the lower part directly behind panel D of the lower housing 16 as is shown in FIGS. 1 and 2 and a closed position when the door 22 is raised to the top of panel D' of the upper housing 16'.

The door 22 that fits within the slots 20 in the opposing faces of gap 18 is an element of convenience and is not absolutely required for the operation of the tub. However, the door 22 can be raised into the closed position to enclose the housing 16' once a bather has been positioned within the basket of the tub in the manner as described hereinafter. The top edge of door 22 may be fitted with a cushioned pad 88 to cover the opening between the bathing basket 56 and lower housing 16. Said cushioned pad would provide a softer edge for bathers to cross over when entering or exiting the bathing basket and would provide a more comfortable edge for an assistant to rest their arms when the door 22 is in the raised position.

Door 22 can be conveniently raised because of the installation of counterbalance weights 24, which are connected to one end of cords 26. The cords 26 are connected at their opposite ends to the door 22 and the intermediate portion of the cords travel over pulleys 28 journaled within the housing 16'. This mechanism allows the door 22 to be lifted into position by releasing latch 81 and the door will be raised into its raised position by the counterbalance weights where it will securely latch at latches 82. The door 22 may be lowered by simultaneously releasing latches 82 and pressing the door down until latch 81 secures it in the lowered position.

The upper housing 16' has a ledge 30 around a U-shaped mouth 32 formed in the top panel F'. The mouth 32 provides an opening for the tub so that a person can sit in the tub and have a portion of his body extending above the top of the housing in the ordinary bathing arrangement.

Bathing basket 56 has an upper perimeter ledge which is shaped to conform to and mates with the ledge 30 in the upper housing 16' so that the bathing basket can rest within the housing and sit on the upper panel F' of the upper housing 16'. The bathing basket 56 is constructed of panels A", B", C", E" and F" and conforms substantially to the shape of the opening in the upper housing 16' created by the gap 18 and the mouth 32. Thus, panels A" and B" serve as the two ends of the bathing basket, panel C" serves as the back of the bathing basket, there is no front panel on the bathing basket other than panels D" which serve as a closure to the interior of the tub, and panel E" serves as the bottom of the bathing basket. A surface F" extends variously about the perimeter of the upper portion of the bathing basket and mates with the U-shaped panel F' of the upper housing 16' so that the bathing basket 56 can sit on the panel F' of the upper housing 16' and be supported by the housing within the opening created by the gap 18 and mouth 32.

The size of the panels A", B" and C" are such that when the bathing basket is resting on the panel F' of the upper housing 16', the bottom E" of the bathing basket 56 is located at a height coterminous with the lower extent of gap 18 at a distance h above the floor 12. The distance h is generally in the 2–2½ foot range and is designed to create a convenient seat for the buttocks of a bather entering the tub. By this arrangement, the bather can sit on the bottom E" of the bathing basket 56 and easily "scoot" into the bathing basket to be in position for the bath. The open front of the bathing basket makes it particularly convenient for the physically or mentally impaired to get into the tub so that they may bathe themselves, or in the more likely situation, be bathed by a bathing assistant such as a hospital or nursing home staff member.

Once the bather, sometimes referred to in this description of the preferred embodiment of the invention as the "patient" because Applicant's invention is particularly adaptable to use in conjunction with the treatment of hospital and nursing home patients which are either mentally or physically impaired, is in the bathing basket, the remote reservoir tub 54 which has been filled with a bathing solution at the desired temperature, is raised into position about the bathing basket. The water will flow into the bathing basket very rapidly so that the patient does not have to sit in the bathing basket for any extended period of time while a tub is being filled.

FIG. 2 illustrates more particularly the lifting structure 80 of the preferred embodiment of the invention which enables both the remote reservoir tub to be raised into position and the bathing basket 56 to be adjusted by height. Specifically, the preferred embodiment includes two lifter stands 34 each of which includes a foundation 36. The foundation 36 includes feet 38 which provides stability to the lifter stand. Cylinder 40 is formed in the foundation 36 and a piston structure including a piston rod 42 having a piston head (not shown) on the lower end thereof is fitted with the cylinder 40. A pump 44 provides hydraulic fluid to opposing sides of the piston head on the piston rod 42 to cause the piston rod 42 to raise and lower within the cylinder 40.

Attached to the upper end of the piston rod 42 is a bracket 46 which raises and lowers with the raising and lowering of the piston rod 42 in response to the hydraulic pressure applied to the piston head. The two lifter stands 34 are mounted on a base 83 which distributes the weight of the apparatus and provides leverage to prevent tilting of the lifter stands. Stably and securely attached to the base 83 are guide posts 84 for the upper housing 16' and guide posts 85 for the remote reservoir 54. The posts 84 are stably mounted to the base 83 of Applicant's invention so as to control the movement of the upper housing 16' along an up and down path. Integrally attached to the upper housing 16' are sleeves 48 which journal along posts 84 so as to provide guidance and stability for the raising and lowering of the upper housing 16'. The posts 85 are stably mounted to the base 83 so as to control movement of the remote reservoir 54 along an up and down path. Integrally attached to the remote reservoir 54 are sleeves 50 which journal along posts 85 so as to provide guidance and stability for the raising and lowering of the remote reservoir 54.

Extending perpendicularly out from each piston rod 42 is a bracket 46, one of which is fastened to the upper housing 16' to cause the raising or lowering of the housing to the desired height in response to movement of its piston rod and the other is fastened to the side of the remote reservoir 54 so as to raise and lower the remote reservoir 54 in response to movement of its piston rod 42. Since the bathing basket 56 rests on and is supported by the upper housing 16' the bathing basket 56 height is adjustable by adjusting the height of the upper housing 16'. In a more simplified version of the present invention where an upper housing is not used, the bracket 46 of the lifter responsible for the movement of the bathing basket would be directly attached to the bathing basket.

The remote reservoir 54 which can be molded or formed from panels includes opposing ends A"', and B"', a back C"', a front D"', and a bottom E"', all formed into a unitary tub open at the top and otherwise constructed to hold a quantity of liquid.

Figure 4:
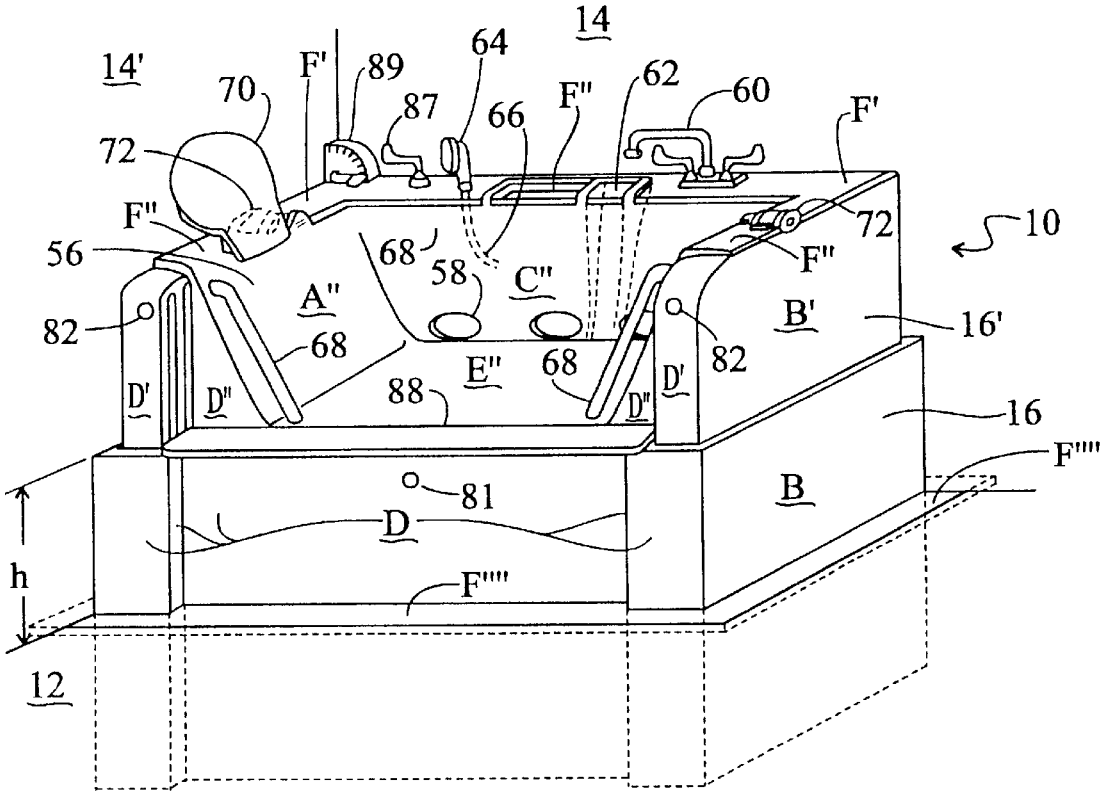
FIG. 4 is a more detailed perspective view of the tub of the present invention.
Figure 5:
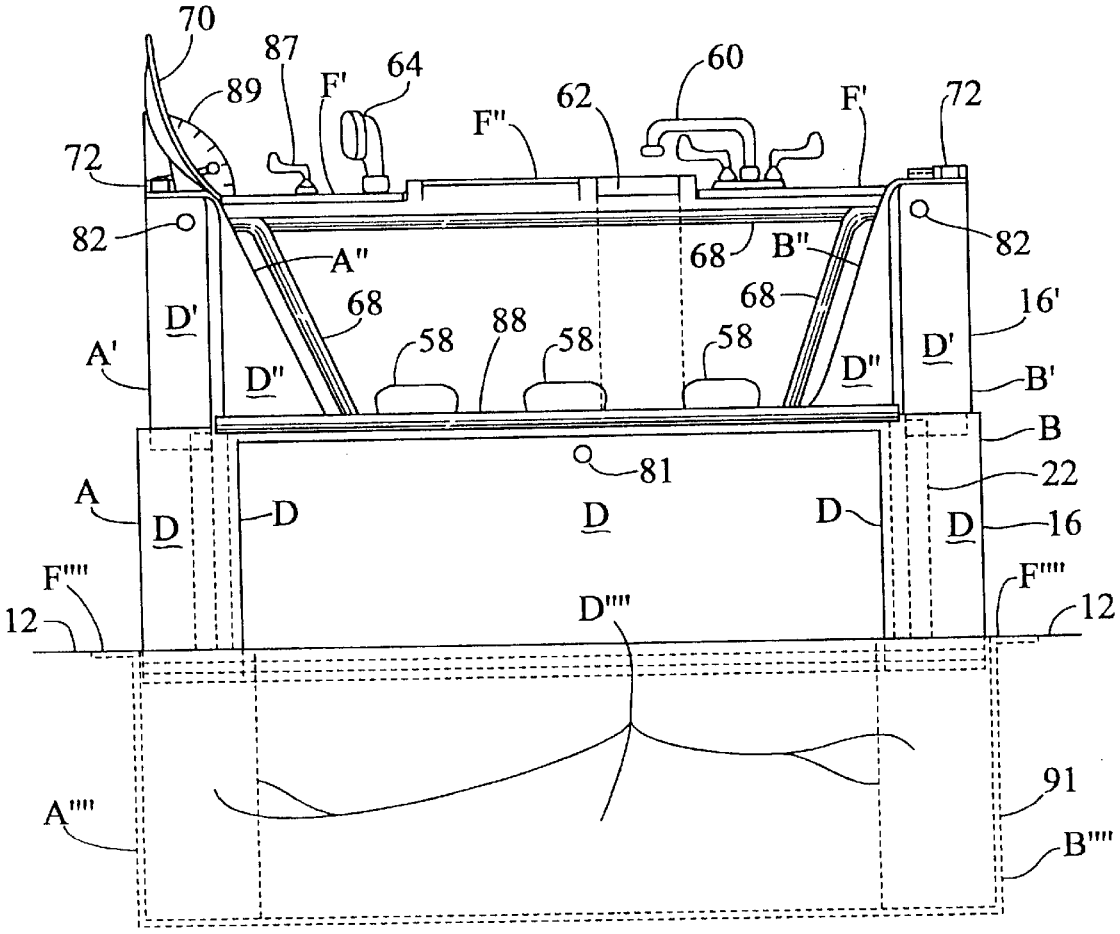
FIG. 5 is a front elevation of the present invention.
Figure 6:
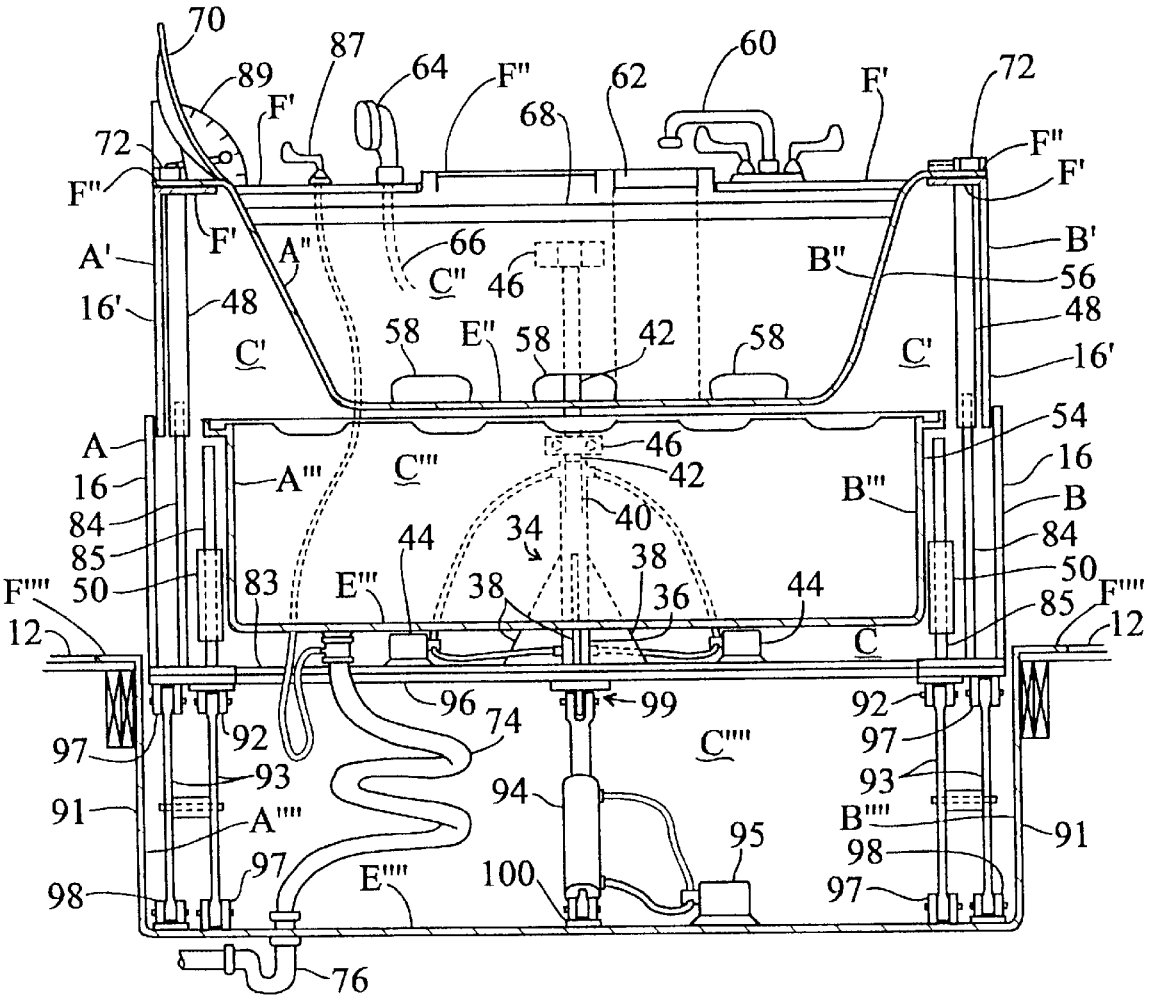
FIG. 6 is a longitudinal sectional view of the tub of the present invention.
Figure 7:
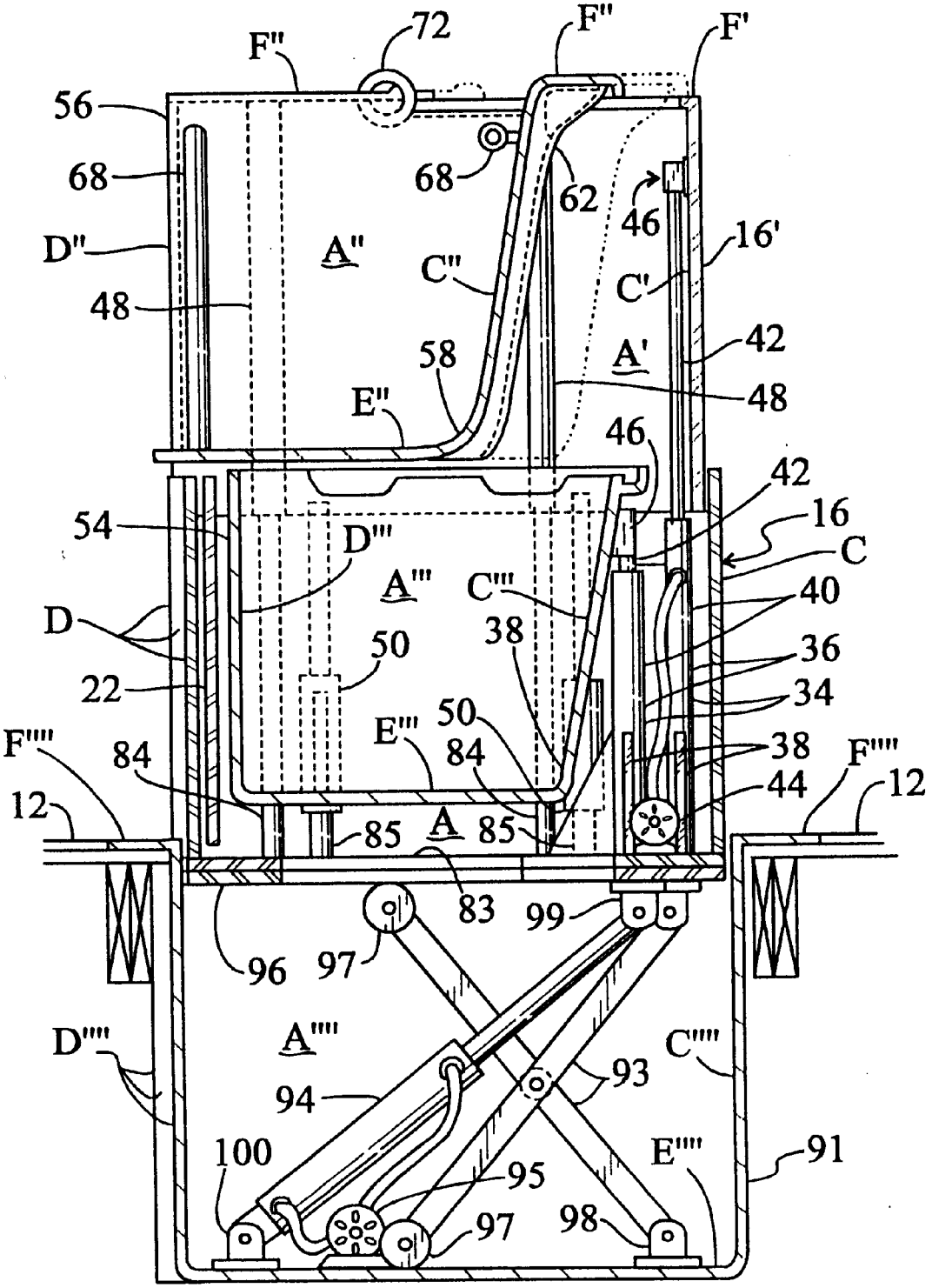
FIG. 7 is a cross sectional view of the tub of the present invention with the remote reservoir down and the basket slipped forward.

As can be seen from FIG. 4, other details of the present invention include a swivel faucet 60 which is used to fill the remote reservoir tub either through an opening 62 in the top panels F" and F' of the bathing basket 56 and the upper housing 16', respectively or directly over the bathing basket 56 top opening. This device may also be provided with a hand-held nozzle 64 connected to the water source for the faucet 60 by a flexible hose 66.

Holes 58 may be provided in the bathing basket, to improve the quickness of transfer of water into and out of the bathing basket from and to the remote reservoir respectively, water will flow through the holes from the remote reservoir into the bathing basket and vice versa as the remote reservoir is raised in position, in a nesting relationship about the bathing basket 56 or lowered from a nesting relationship. The open front of the bathing basket 56 also facilitates quick water transfer. The bathing basket may also include grab rails 68 and a head rest 70 as a convenience to the bathing patient.

Figure 8:
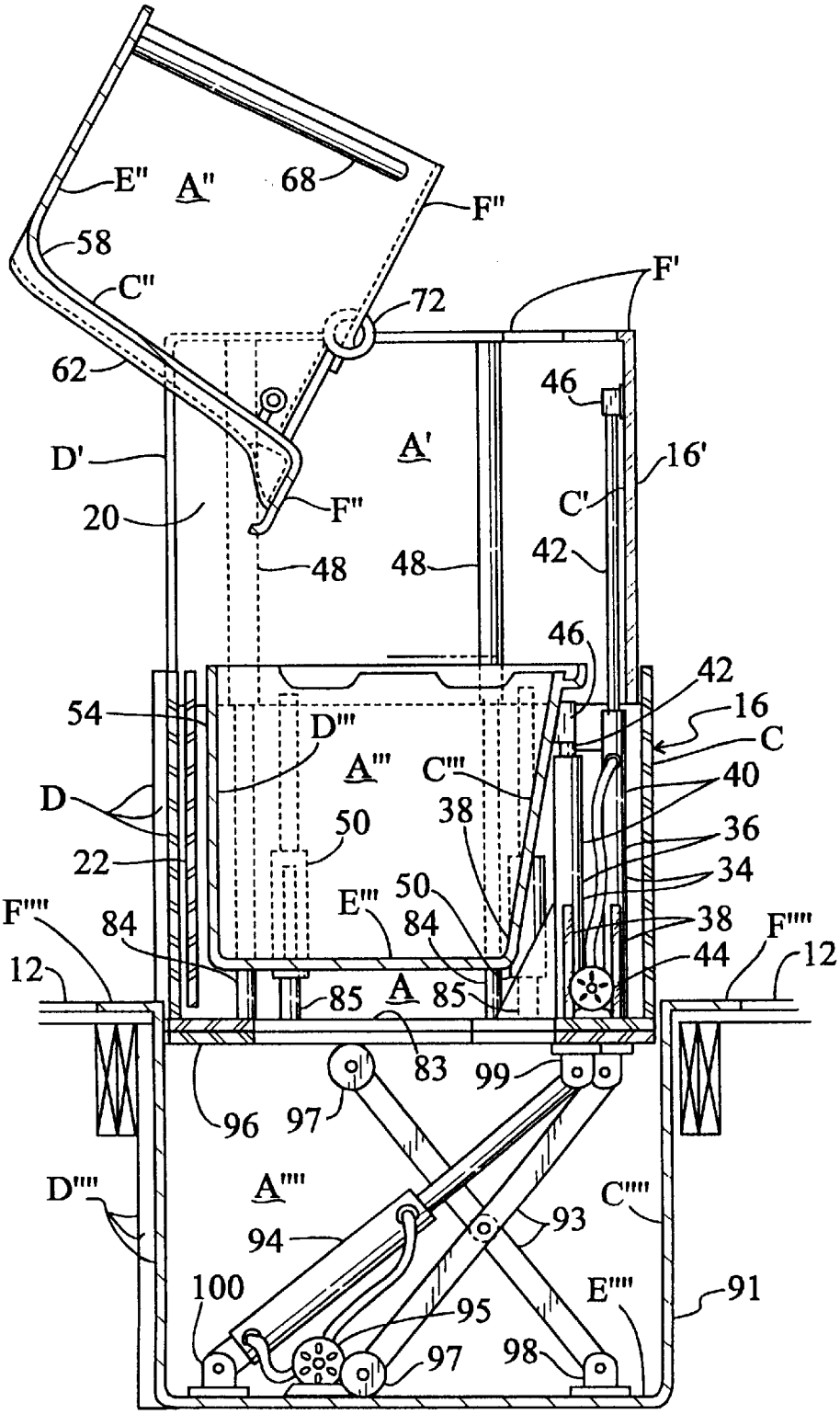
FIG. 8 is a cross sectional view of the tub of the present invention with the remote reservoir down and the basket tilted for cleaning.

The bathing basket 56 may be mounted via pivot pins 72 sitting within a slide on the upper panel of the upper housing 16' so that the bathing basket can be slid towards the front of the structure and then rotated into the position shown in FIG. 8 for cleaning.

A drain 74 (see FIG. 6) of some appropriate flexible structure to accommodate the raising and lowering of the remote reservoir 54, can be attached between an outlet port in the bottom E"' of the remote reservoir 54 and drain pipe 76 in order to drain the tub by opening valve 86 with handle 87 when the bathing process is finished.

A timer mechanism 89 may be provided whereby the timer has to be reset manually at short intervals such as two minutes or else when the timer winds down it triggers a bypass valve to open in the hydraulic cylinder holding up the remote reservoir so the remote reservoir lowers. This safety device will cause the remote reservoir to default to a lowered position if the bather or assistant is not mentally or physically able to reset the timer thereby removing the bathwater away from the bather to prevent accidental drowning. A similar type device may be used to cause the raising of the bathing basket out of the remote reservoir where the method of immersion is to lower the bathing basket into the remote reservoir.

The entire tub may be further adjusted in height relative to the floor 12 by providing a floor recessed lifting device 90. Such lifting device consists of a recessed support pan 91 formed by panels identified by letters A"", B"", C"", D"", E"" and F"" designating opposing ends A"" and B"", a back C"", a front D"", a bottom E"" and a top flange F"". Said support pan 91 is supported by flange F"" resting on floor 12. Floor E"" of support pan 91 provides support for a lifting device 90 such as a hydraulic scissor jack. The scissor jack is comprised of two hinged scissor "X" mechanisms 93, a hydraulic cylinder mechanism 94, a hydraulic pump 95 and an open platform 96. Rollers 97 are provided for the non-hinged ends of the scissor "X" mechanism to allow smooth operation as the scissor jack is raised or lowered. The upper hinge 92 of the "X" mechanism 94 is securely fastened to the open platform 96. The lower hinge 98 of the "X" mechanism 94 is securely fastened to the bottom E"" of support pan 91. Hydraulic cylinder mechanism 94 has its piston rod secured by hinged bracket 99 to the open platform 96 and has its cylinder end secured by hinged bracket 100 to the bottom E"" of support pan 91. Additionally, hydraulic pump 95 is secured to the bottom E"" of support pan 91. The design of the lifting device 90 is such that the open platform 96 is raised and lowered parallel to the floor E"" of the recessed support pan 91.

The open platform 96 matches the shape of the base 83 of the lifting structure 80 and supports the bathing system comprised by the lifting structure 80, the remote reservoir tub 54, the lower housing 16, the door 22, the upper housing 16' and the bathing basket 56. By operation of the lifting device 90, the bathing system can be lowered into the floor 12 until the top of the lower housing 16 is flush with the floor 12 and the bottom E" of the bathing basket 56 is level with the floor 12. This positioning allows the bathing system to be operated as a conventional height bathtub for either immersion type bathing or showering while standing in the bathing basket. The lifting device 90 can be raised thereby elevating the bathing system to any elevation desired up to where the top of the lower housing 16 and the bottom E" of the bathing basket 56 are at their height limit "h" of 2 to 2½ feet high to accommodate easier access for the physically or mentally impaired bather.

Additionally, if the bathing basket 56 is positioned where its floor E" is approximately level with floor 12 and the remote reservoir tub 54 is positioned in its lowered position where it would be below the floor 12, a bather could conceivably enter the bathing basket 56 and have it lowered into a pre-filled remote reservoir tub 54 and effectively enjoy a bath in a sunken tub.

Figure 9:
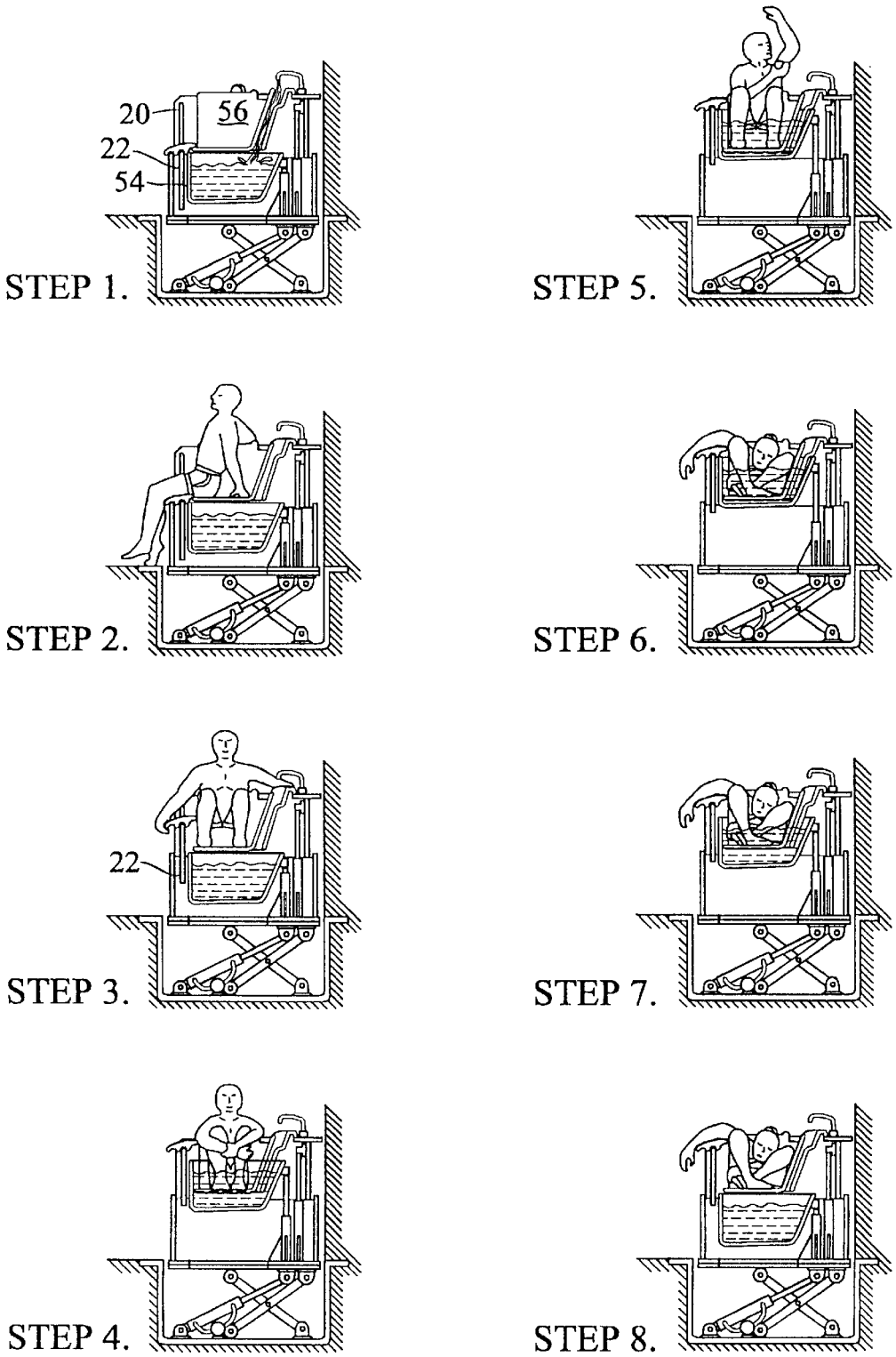
FIG. 9 is a schematic view showing the use of the tub of the present invention in eight distinct steps.

Referring to FIG. 9, the various steps of operation of the remote reservoir tub of Applicant's invention are illustrated. Step 1 shows the tub with the bathing basket in its raised position and with the remote reservoir lowered and being filled with water. The door 22 is also lowered so that the bather can enter the tub. Step 2 shows the bather sitting in the bathing basket over the lowered door 22. As can be seen from Step 2, the bathing solution in the remote reservoir can be filled to the desired height and at the desired temperature without the bather having to be in the tub or touch the water. Under this arrangement, the bather will not be scalded by water that is too hot or chilled by water that is too cold as the bathtub is being filled. Further, the remote reservoir can be filled as is shown in Step 1 of FIG. 9 while the bather is positioned in the bathing basket without the water coming in contact with the bather. Thus, as soon as the bather is in the bathing basket, the remote reservoir can be raised to effect an almost instant filling of the bathing solution in the bathing basket.

Step 3 illustrates the bather within the bathing basket and in the process of raising the door 22 to provide the bather with some support along the front of the tub and protection from falling out of the tub as he sits within the bathing basket. Of course, situating the bather within the bathing basket may involve the assistance of a nurse or nurse's aid for the mentally or physically impaired patients in hospitals and nursing homes. Once the door 22 is raised (and even if door 22 is left in the lowered position), the remote reservoir may be raised by the operator pressing a switch to provide power to the pump that activates the hydraulic system that causes the piston rod 42 of the remote reservoir lifting mechanism to raise. Raising the support lifter mechanism of the lifter stand 34 raises the bracket 46 which in turn will raise the remote reservoir into the position shown in Step 5. Step 4 shows the remote reservoir in the process of being raised.

The remote reservoir, as previously indicated, is designed to mate with the bathing basket and fit about it in a nesting relationship. However, because the bathing basket has an open front and has holes 58 in the back side of it, the water within the remote reservoir will flood immediately into the bathing basket so that the bather will be totally immersed in water practically instantly once the remote reservoir is raised. By this arrangement, the bather is not required to sit exposed in a tub while it is being filled from the normal flow through a faucet. The bather is protected against being scalded or chilled by water passing from the faucet that has not been properly adjusted, and the time spent in the bathing process can be substantially reduced.

Step 5 illustrates the patient in the tub with the remote reservoir raised into an operable position. Step 6 illustrates the danger of being in the tub if, during the course of the bath, the patient loses consciousness. Under those circumstances, the assistant would throw a switch to reverse the hydraulic pressure that is holding the raised remote reservoir in position and lower the remote reservoir into position shown in Step 8 or if the bather is unattended the bather will be unable to reset the timer and the timer will automatically trigger the lowering of the remote reservoir when it winds down. The water will drain from the bathing basket practically instantly because of the open front of the bathing basket and the holes 58 so that if the patient falls into the bathing basket in the manner illustrated in Step 6 where the bather's mouth and nose may be below water, the patient will not drown before he can be removed from the tub. Step 7 shows the remote reservoir in the process of being lowered.

As a more practical illustration of the use of the remote reservoir tub of the present invention, if during the course of the bathing process, the patient advises the bathing assistant of the need to urinate or experience a bowel movement, the bathing assistant can immediately lower the remote reservoir 54, drop the door 22, remove the patient and assist him to a toilet, and when the patient is finished and ready to return to complete his bath, the patient can reenter the bathing basket, the door can be raised and the remote reservoir which contains the patient's original bath water raised into position and the bathing process completed. In this situation, the bath tub does not have to be drained with the loss of the bathing solution, and there is no wasted time associated with having to drain the water from a tub and then refill it to complete the bathing process.

Once the bath has been completed, the bathing basket can be rotated to the position shown in FIG. 8 so that the basket itself and the remote reservoir can be cleaned and disinfected for the next patient.

It would be possible to construct Applicant's remote reservoir tub so that the open front bathing basket itself can be lowered into a tub of bathing water and then raised to remove the patient after the bathing process is completed. However, such a configuration is less desired because it requires the bathing assistant to stoop over to a lower position to assist in the bathing process. However, such a structure would be usable in those circumstances where the bather has some difficulty getting in and out of a tub but does not require assistance in the bathing process, such as for obese bathers or the like. In such a structure, a lifter mechanism would be connected to the upper housing supporting the bathing basket to move the bathing basket relative to a stationary reservoir of bathing solution so that when the bathing basket with its open front is raised, the patient can enter it and press a button causing the bathing basket to lower into the bathing solution.

Although there have been described particular embodiments of the present invention of a new and useful Telescoping Bathtub Assembly, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A telescoping bathtub assembly comprising:

a bathing basket having an elongated, predetermined size and shape for supporting a bather in a reclined position, said bathing basket having a perimeter with a first portion of the perimeter serving as the front of the bathing basket, said bathing basket including at least one wall substantially enclosing said bathing basket about its perimeter except for said portion of the perimeter serving as the front of the bathing basket thereby creating a substantially enclosed bathing basket with an opening at said portion of the perimeter serving as the front of the bathing basket whereby a bather can conveniently ingress and egress the bathing basket through said opening;

a tub having a size and shape configured to cooperatively fit about and mate with the predetermined size and shape of the bathing basket, said tub being positioned beneath the bathing basket, moving means for moving said tub vertically into a nesting relationship about said bathing basket whereby a bathing solution filling said tub will flood into said bathing basket through said opening to engulf a bather positioned within said bathing basket; and the bathtub assembly further comprising a housing within which said bathing basket and said tub are mounted, said housing having a front with a gap, said gap being in registry with the open front of said bathing basket.

2. The device of claim 1 further comprising a door for closing said gap.

3. A telescoping bathtub assembly including a bathing basket with an open front whereby a bather can conveniently ingress and egress the bathing basket, a tub shaped and sized to fit about the bathing basket, said tub being positioned beneath the bathing basket and means for moving said tub vertically into a nesting relationship about said bathing basket whereby a bathing solution filling said tub will flood into said bathing basket to engulf a bather positioned within said bathing basket; and further including a housing within which said bathing basket and said tub are mounted, said housing having a front with a gap, said gap being in registry with the open front of said bathing basket, a door for closing said gap and pulleys mounted in said housing and counterbalanced weights attached to cords passing over said pulleys to thereby reduce the strength required to close said door.

4. A telescoping bathtub assembly including a bathing basket with an open front whereby a bather can conveniently ingress and egress the bathing basket, a tub shaped and sized to fit about the bathing basket, said tub being positioned beneath the bathing basket and means for moving said tub vertically into a nesting relationship about said bathing basket whereby a bathing solution filling said tub will flood into said bathing basket to engulf a bather positioned within said bathing basket; and further including means for mounting said bathing basket for rotation relative to said tub whereby said bathing basket can be rotated to a position allowing access to the underside of said bathing basket and inside of said tub so that both may be cleaned and disinfected.

5. A telescoping bathtub assembly including a bathing basket with an open front whereby a bather can conveniently ingress and egress the bathing basket, a tub shaped and sized to fit about the bathing basket, said tub being positioned beneath the bathing basket and means for moving said tub vertically into a nesting relationship about said bathing basket whereby a bathing solution filling said tub will flood into said bathing basket to engulf a bather positioned within said bathing basket; and further including a housing within which said bathing basket and said tub are mounted, said housing having a front with a gap, said gap being in registry with the open front of said bathing basket.

6. A telescoping bathtub assembly comprising:

a bathing basket having sides, the sides defining a side opening adapted to provide a bather convenient ingress and egress the bathing basket, the bathing basket further having a seating areas, a remote reservoir shaped and sized to fit about the bathing basket, the remote reservoir operably positioned beneath the bathing basket;

reservoir moving means for moving said remote reservoir vertically into a nesting relationship about said bathing basket;

basket moving means for moving said bathing basket vertically into a nesting relationship within said remote reservoir whereby a bathing solution filling said tub will flood into said bathing basket to engulf a bather positioned within said bathing basket when either or both the remote reservoir and bathing basket are moved vertically to cause a nesting relationship to occur;

the bathtub assembly further comprising a support surface on which the remote reservoir, the bathing basket, and the reservoir moving means can be mounted, and means for raising and lowering, as a subassembly, the remote reservoir, the bathing basket, and the reservoir means between a first position and a second position wherein the first position includes the subassembly lowered beneath the support surface so that the seating area of the bathing basket is level with the support surface and the remote reservoir is raised above the support surface and the second position includes the subassembly raised so that the seating area of the bathing basket is elevated above the support surface at a convenient height for ingress and egress.

7. A telescoping bathtub assembly comprising:

a bathing basket having sides, the sides defining a side opening adapted to provide a bather convenient ingress and egress the bathing basket, the bathing basket further having a seating area, a remote reservoir shaped and sized to fit about the bathing basket, the remote reservoir operably positioned beneath the bathing basket;

reservoir moving means for moving said remote reservoir vertically into a nesting relationship about said bathing basket;

basket moving means for moving said bathing basket vertically into a nesting relationship within said remote reservoir whereby a bathing solution filling said tub will flood into said bathing basket to engulf a bather positioned within said bathing basket when either or both the remote reservoir and bathing basket are moved vertically to cause a nesting relationship to occur;

the bathtub assembly further including an upper housing containing and supporting said bathing basket; and further including a lower housing containing said remote reservoir wherein the upper housing has a front with a gap, said gap being in registry with the side opening of said bathing basket and wherein the upper housing is slightly smaller in perimeter than the lower housing so that the upper housing fits within the lower housing as the upper housing is lowered.

* * * * *